United States Patent [19]

Carlson

[11] Patent Number: 4,625,881

[45] Date of Patent: Dec. 2, 1986

[54] PRESSURIZED TANK HAVING RESILIENT SUPPORT

[76] Inventor: Franklin J. Carlson, 1081 Wisconsin Ave., Okauchee, Wis. 53029

[21] Appl. No.: 777,190

[22] Filed: Sep. 18, 1985

[51] Int. Cl.[4] ..... F17C 13/08

[52] U.S. Cl. ..... 220/69; 220/85 K

[58] Field of Search ..... 220/69, 3, 85 K

[56] References Cited

U.S. PATENT DOCUMENTS

| | | | |
|---|---|---|---|
| 3,143,243 | 8/1964 | MacKusick | 220/69 |
| 3,963,226 | 6/1976 | Jankowski, Jr. | 220/69 X |
| 4,372,458 | 2/1983 | Carlson | 220/85 K X |
| 4,511,055 | 4/1985 | Carlson | 220/69 |

FOREIGN PATENT DOCUMENTS

| | | | |
|---|---|---|---|
| 22947 | 6/1972 | Australia | 220/85 K |
| 1411837 | 8/1965 | France | 220/85 K |

*Primary Examiner*—Steven M. Pollard

*Attorney, Agent, or Firm*—Andrus, Sceales, Starke & Sawall

[57] ABSTRACT

A pressurized tank construction having a resilient protective skirt attached to a head of the tank. A ring is welded to the tank head prior to heat treatment of the tank. After heat treatment a second ring carrying an annular resilient skirt and having a larger diameter than the first ring is secured directly to the first ring so there is no direct attachment of the second ring to the tank. The skirt provides a stable support for the tank and cushions the tank during handling and transporting. With smaller sized tanks a metal ring having a laterally extending outer lip is welded to the tank head and a resilient ring is snap-fitted into engagement with the lip to provide a support for the tank.

10 Claims, 11 Drawing Figures

FIG. 1
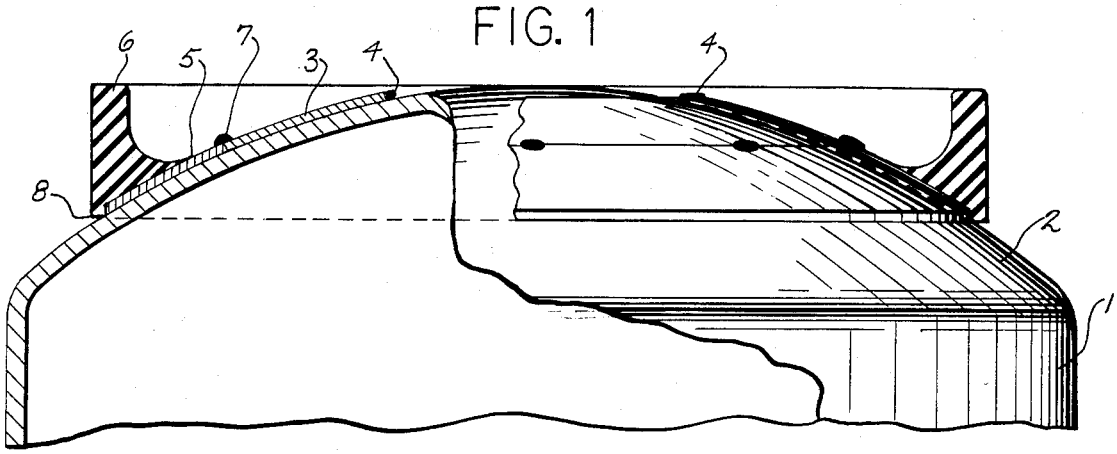
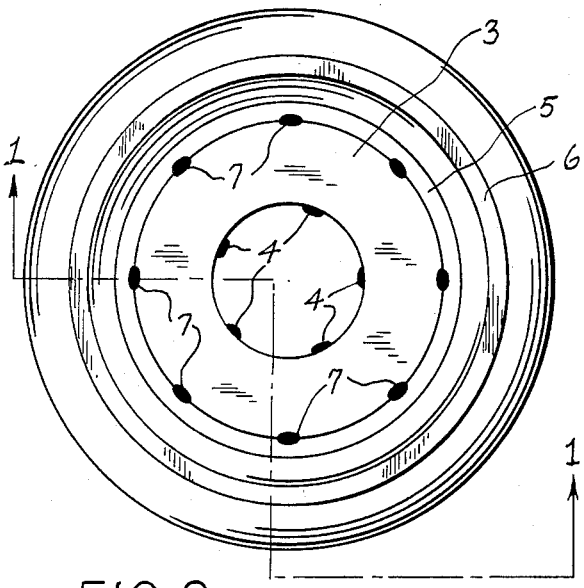
FIG. 2
FIG. 3
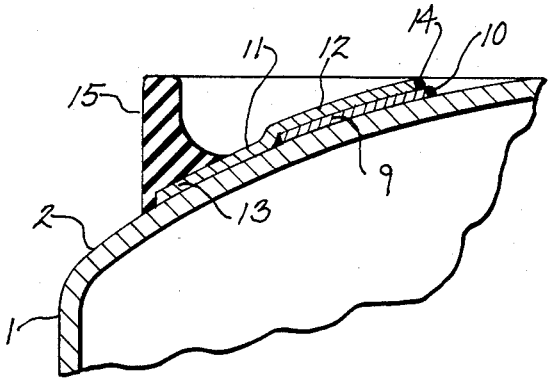
FIG 4
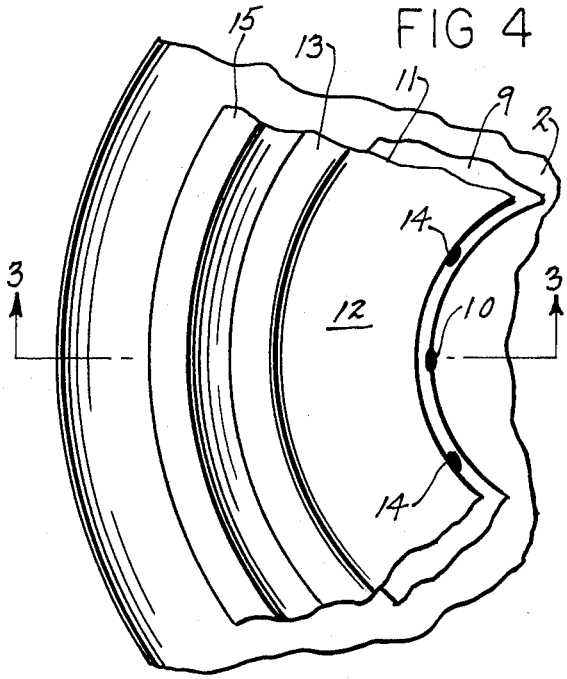
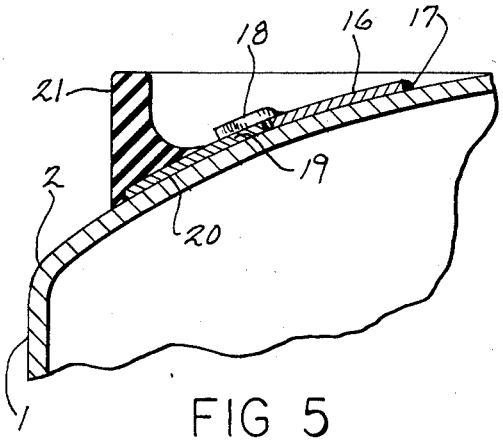
FIG 5

PRESSURIZED TANK HAVING RESILIENT SUPPORT

BACKGROUND OF THE INVENTION

The heads of metal tanks are frequently provided with resilient supporting skirts made of rubber or plastic material. The skirts aid in cushioning the tank during handling, preventing sliding movement of the tank during transporting and also serve to prevent sparking as the metal tank is slid across a surface.

With non-pressurized tanks, such as used with soft drink syrup, a metal ring carrying a resilient skirt, is welded directly to the tank head. A construction of this type is shown in U.S. Pat. No. 4,372,458.

With tanks adapted to contain pressurized fluids, such as propane and other gases, heat treating of the tank is required and the metal ring that carries the resilient skirt cannot be welded directly to the tank before heat treating because the elevated heat treating temperatures would destroy the rubber skirt. Conversely, the metal ring carrying the rubber skirt cannot be welded to the tank after heat treatment because the welding would destroy the heat treated properties of the tank. U.S. Pat. No. 4,511,055, discloses a manner of attaching a resilient skirt to a pressurized tank. In that patent a series of threaded studs are welded to the head of the tank prior to heat treatment, and after heat treatment, the metal ring that carries the resilient skirt is secured to the studs.

SUMMARY OF THE INVENTION

The invention is directed to a pressurized tank construction having a resilient annular protective skirt attached to at least one of the heads of the tank. In accordance with the invention, a ring is welded to the tank head prior to heat treatment of the tank. After heat treatment, a second ring, carrying a resilient skirt and having a larger diameter than the first ring, is located against the head radially outward of the first ring. The second ring is connected directly to the first ring, so there is no direct attachment or weld of the second ring to the tank head.

The resilient annular support or skirt is bonded to the second ring and projects in an axial direction beyond the head and serves to support and protect the tank.

The invention provides a manner of attachment of a resilient supporting skirt to a pressurized tank in which the skirt is connected to the tank after heat treatment and without the metal ring that supports the skirt being directly welded to the heat treated tank.

The resilient skirt provides a stable support for a dome-shaped tank, cushions the tank during handling and minimizes shifting or sliding movement of the tank during transporting.

In a second form of the invention, as used with smaller sized pressurized tanks, a ring having a laterally projecting outer lip is welded to the tank head, and a resilient or rubber ring is snap-fitted into engagement with the projecting lip of the metal ring.

Other objects and advantages will appear in the course of the following description.

DESCRIPTION OF THE DRAWINGS

The drawings illustrate the best mode presently contemplated of carrying out the invention.

In the drawings:

FIG. 1 is a longitudinal section showing the attachment of an annular resilient supporting skirt to a tank head;

FIG. 2 is a plan view of the tank head shown in FIG. 1;

FIG. 3 is a longitudinal section of a modified form of the invention;

FIG. 4 is a plan view of the structure shown in FIG. 3;

FIG. 5 is a longitudinal section of a second modified form of the invention;

DESCRIPTION OF THE PREFERRED EMBODIMENT

Figure 6:
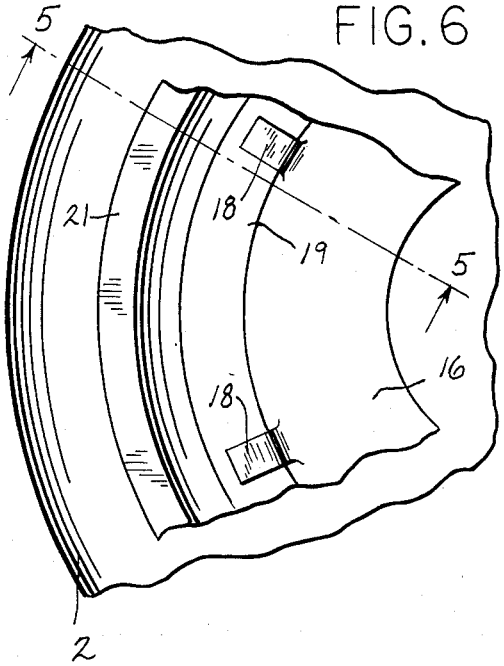
FIG. 6 is a plan view of the structure shown in FIG. 5.

FIGS. 1 and 2 illustrate a metal tank 1 to contain a pressurized fluid, such as a pressurized gas. The ends of the tank are enclosed by a dome-shaped head 2.

In accordance with the invention, a metal ring 3 is secured to the head 2 through a series of tack welds 4. The ring is contoured to the shape of the head, so that it is in continuous contact with the head.

A second ring 5, having a larger diameter than ring 3, is located radially outward of ring 3 and carries a resilient annular skirt 6 formed of rubber or plastic material. Skirt 6 is vulcanized or otherwise bonded to ring 5. The inner peripheral edge of ring 5 is secured to the outer peripheral edge of ring 3 through a series of welds 7.

The outer end of skirt 6 projects in an axial direction beyond head 2 and can serve as an annular support for the tank.

As shown in FIG. 1, the outer periphery of skirt 6 projects beyond ring 5 and defines a lip 8 which is disposed in engagement with head 2. The lip 8 serves to prevent leakage of moisture under the ring 5 and thus prevents possible corrosion of the metal ring 5 and tank head 2.

Ring 3 is intended to be welded to tank head 2 prior to heat treating of the tank. After heat treatment, the tank and FIG. 3 can be painted, if desired, and ring 5 carrying skirt 6 is then welded to ring 3, so that no welds are made directly to the tank head 2 after heat treatment.

The resilient skirt 6 can be applied to either the upper or lower heads of the tank, or both, and in some cases the skirt may be provided with hand holes for lifting the tank.

FIGS. 3 and 4 show a modified form of the invention. A metal ring 9, similar to ring 3 is secured to the tank head 2 through a series of welds 10. A second ring 11 has an inner section 12 which is disposed in overlapping relation to ring 9, and an outer section 13 which extends radially beyond the outer edge of ring 9. Outer section 13 of ring 11 is secured to ring 9 through a series of welds 14.

A resilient skirt 15, similar in construction to skirt 6, is bonded to the outer section 13 of ring 11.

As described in connection with the first embodiment, ring 9 is welded to tank head 2 prior to heat treatment, and after heat treatment, the outer ring 11, which carries skirt 15 can be welded to inner ring 9. Again, welds 13 are not made directly to the heat treated tank 2.

FIGS. 5 and 6 illustrate a further modified form of the invention, in which a ring 16, similar in construction to rings 3 and 9, is secured to tank head 2 through tack welds 17. Ring 16 is provided with a series of circumferentially spaced tabs 18 which are bent downwardly into firm engagement with the inner section 19 of an outer ring 20. The bent tabs 18 serve to hold the ring 20, which carries a resilient annular skirt 21, in position on the tank head.

As previously described, ring 16 is welded to tank head 2 prior to heat treatment of the tank and after heat treatment, ring 20 which carries rubber skirt 21, can be attached to the ring 16 by bending down the tabs 18.

Figure 7:
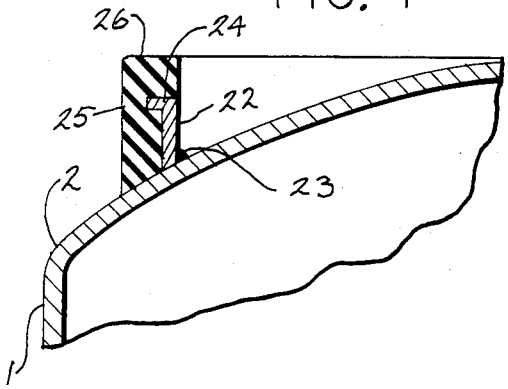
FIG. 7 is a longitudinal section of a third modified form of the invention.
Figure 8:
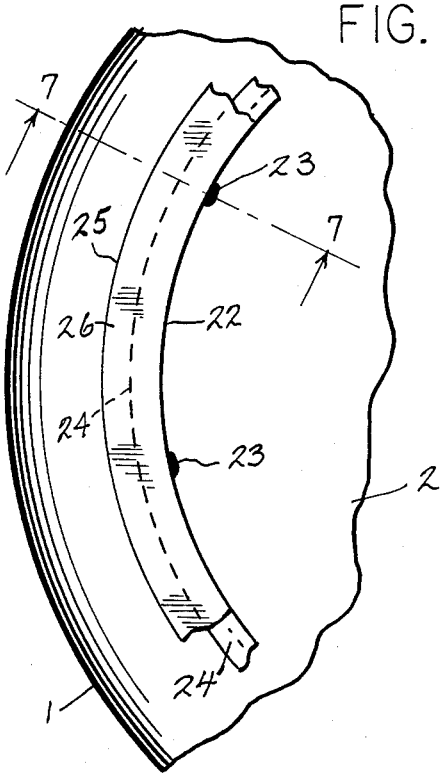
FIG. 8 is a plan view of the structure shown in FIG. 7.

FIGS. 7 and 8 illustrate a further modified form of the invention which can be utilized to attach a resilient skirt to a smaller sized pressurized tank. As shown in FIG. 7, a metal ring 22 is secured endwise to tank head 2 by a series of welds 23. The outer edge of ring 22 defines a laterally projecting lip 24 that is received within a circumferential groove in the inner surface of annular resilient skirt 25. The inner end of skirt 25 bears against tank head 2, while the outer surface 26 of skirt 25 provides a supporting surface for the tank.

Metal ring 22 is welded to tank head 2 prior to heat treatment, and after heat treatment, and painting, if desired, the skirt is attached by stretching the skirt outwardly and snapping the lip 24 into engagement with the groove 26 in the skirt.

The construction of FIGS. 7 and 8 has particular use for propane tanks associated with barbeque grills and recreational vehicles. In this usage, ring 22 will fit around a fixture to hold the tank in place, and as the assembly of ring 22 and skirt 25 has a uniform internal diameter, it will fit more snugly on the fixture.

Figure 9:
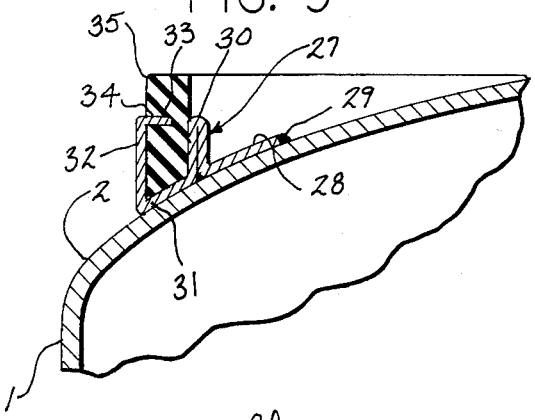
FIG. 9 is a longitudinal section of a fourth modified form of the invention.
Figure 10:
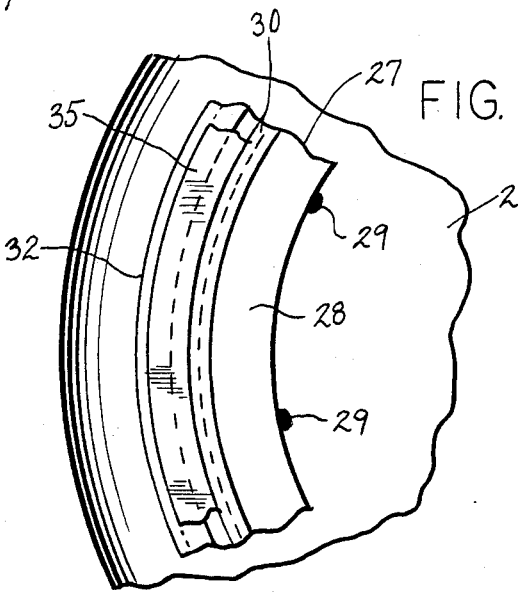
FIG. 10 is a plan view of the structure shown in FIG. 9.

FIGS. 9 and 10 illustrate a further modified form of the invention in which a metal ring 27 is welded to the head 2 of tank 1 prior to heat treatment of the tank. Ring 27 is provided with an inner section or base 28 that is secured to tank head 2 thorugh welds 29. Located radially outward of inner section 28 is a reverse bent wall 30 and the wall 30 is connected to an outer base section 31. An outer wall 32 extends outwardly from base section 31 and is generally parallel to wall 30. As shown in FIG. 10, the outer edge of wall 32 is provided with an inwardly extending lip 33 which is adapted to be engaged with a groove 34 in resilient annular skirt 35. The flexibility of the skirt 35 and the outer wall 32 enables the lip 33 to be engaged with the groove 34.

The construction shown in FIGS. 9 and 10 is adapted for use with somewhat larger sized tanks than that of FIGS. 7 and 8 and the inner and outer walls 30 and 32 provide additional support for the resilient skirt 35.

Figure 11:
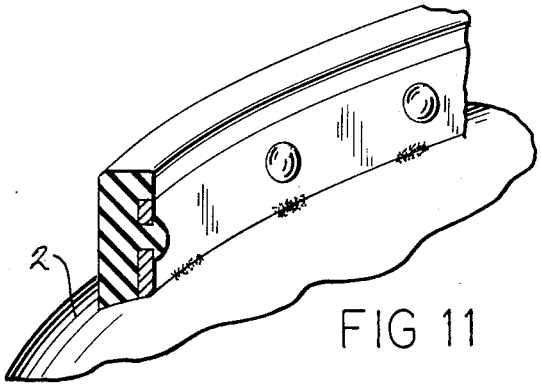
FIG. 11 is a perspective view showing a further modified form of the invention

FIG. 11 shows a further modified form of the invention in which a metal ring 36 is welded edgewise to head 2 of tank 1 by welds 37, and ring 36 is formed with a plurality of holes 38 which are spaced circumferentially of the ring. Engaged with the outer peripheral surface ring 36 is a resilient skirt 39, similar to skirt 25, and the skirt is connected to ring 36 by projections or grommets 40 having enlarged heads 41 that snap-fit into holes 38.

Ring 36 is welded to tank head 2 prior to heat treatment of the tank, and after heat treatment, circular skirt 39 is stretched around ring 36 and the projections 40 inserted into holes 38 to complete the assembly.

Various modes of carrying out the invention are contemplated as being within the scope of the following claims particularly pointing out and distinctly claiming the subject matter which is regarded as the invention.

I claim:

1. A tank construction, comprising a metal tank to contain a pressurized fluid and having a dome-shaped head, a first ring secured to the head, a second ring disposed radially outward of said first ring and disposed in engagement with said head, said second ring being connected directly to said first ring and being free of direct attachment to said head, the inner peripheral portion of the second ring overlapping said first ring, said second ring being secured to the outer surface of the first ring, and a resilient annular skirt secured to the second ring and projecting in an axial direction beyond said head.

2. The tank construction of claim 1, wherein the outer periphery of said skirt project radially beyond the outer periphery of said second ring and is disposed in sealing engagement with said tank.

3. The tank construction of claim 1, wherein said second ring is welded to said first ring.

4. The tank construction of claim 1, wherein the said second ring includes an inner peripheral portion that overlaps said first ring and an outer peripheral portion that is disposed in engagement with said head, said skirt being secured to said outer portion.

5. The tank construction of claim 4, wherein said inner and outer portions are offset.

6. The tank construction of claim 1, and including a plurality of bendable tabs extending radially from one of said rings and disposed in overlapping relation to the other of said rings.

7. The tank construction of claim 1, wherein the outer periphery of said first ring is provided with a plurality of circumferentially spaced tabs which are disposed in overlapping relation to the inner peripheral portion of said second ring.

8. A tank construction, comprising a metal tank to contain a pressurized fluid and having a dome-shaped head, a first ring secured to the head, a second ring disposed radially outward of said first ring and disposed in engagement with said head, said second ring being connected directly to said first ring and being free of direct attachment to said head, a plurality of bendable tabs extending radially from one of said rings and disposed in overlapping relation to the other of said rings to secure said second ring to said first ring, and a resilient annular skirt secured to said second ring and projecting in an axial direction beyond said head.

9. A tank construction, comprising a metal tank to contain a pressurized fluid and having a dome-shaped head, a first ring secured to the head, a second ring disposed radially outward of said first ring and disposed in engagement with said head, said second ring being connected directly to said first ring and being free of direct attachment to said head, a plurality of circumferentially spaced tabs on said first ring and disposed in overlapping relation to the inner peripheral portion of said second ring to connect said second ring to said first ring, and a resilient annular skirt secured to the second ring and projecting in an axial direction beyond said head.

10. A method of securing a resilient skirt to a tank adapted to contain a pressurized fluid, comprising the steps of forming a tank with a dome-shaped head, welding a first ring to said head, heat treating the tank with the attached first ring, forming a second ring with a larger outer diameter than said first ring, securing an annular resilient skirt to the outer surface of said second ring, positioning the inner surface of said second ring in engagement with said head and positioning the outer diameter of said second ring radially outward of the outer diameter of said first ring, and welding the second ring to the first ring while maintaining the second ring free of direct attachment to said head.

* * * * *